US006626647B2

(12) United States Patent
Herrmann

(10) Patent No.: US 6,626,647 B2
(45) Date of Patent: Sep. 30, 2003

(54) RADIAL PISTON PUMP

(75) Inventor: Michael Herrmann, Lebach (DE)

(73) Assignee: ZF Batavia LLC, Batavia, OH (US)

( * ) Notice: Subject to any disclaimer, the term of this patent is extended or adjusted under 35 U.S.C. 154(b) by 0 days.

(21) Appl. No.: 10/052,023

(22) Filed: Jan. 18, 2002

(65) Prior Publication Data

US 2002/0146327 A1 Oct. 10, 2002

(30) Foreign Application Priority Data

Jan. 19, 2001 (DE) ..... 101 02 397

(51) Int. Cl.[7] ..... F04B 49/00; F04B 39/10
(52) U.S. Cl. ..... 417/269; 417/560; 91/499
(58) Field of Search ..... 417/269, 270, 417/273, 545, 560; 91/499; 92/12.2

(56) References Cited

U.S. PATENT DOCUMENTS 2,801,596 A 8/1957 Sewell ..... 417/270
3,183,850 A * 5/1965 Raymond ..... 417/273
3,682,572 A * 8/1972 Yarger ..... 417/273
6,334,762 B1 * 1/2002 Hauser et al. ..... 417/569
6,497,562 B1 * 12/2002 Greiff et al. ..... 417/560

FOREIGN PATENT DOCUMENTS

DE 2616437 A1 * 10/1977
DE 3208770 A1 9/1983
DE 4139611 A1 6/1993
DE 19729790 A1 1/1999
DE 19820136 A1 8/1999

* cited by examiner

*Primary Examiner*—Cheryl J. Tyler
*Assistant Examiner*—Michael K. Gray
(74) *Attorney, Agent, or Firm*—Davis & Bujold, P.L.L.C.

(57) ABSTRACT

The radial piston pump possesses a pump body with a plurality of cylinder borings for the reception of pump pistons which can be driven by a cam. The cylinder borings are closed by valve plugs in which pressure passages are provided. In the pressure passages, outlet valves are inserted which respectively possess a valve stem (7) an end of which, proximate to the pump piston (1), is provided with an impact plate.

9 Claims, 1 Drawing Sheet

RADIAL PISTON PUMP

FIELD OF THE INVENTION

The present invention concerns a radial piston pump with a pump body, in which a plurality of cylinder borings are provided to receive pump pistons, which are driven by an eccentric cam.

BACKGROUND OF THE INVENTION

A radial piston pump, as a component of an automatic transmission, has been made known by DE A 41 39 611 and serves for the supply of oil for lubrication as well as for control and activation of equipment. The driving part of the radial piston pump, in this service, is connected with a startup apparatus placed ahead of the transmission, wherein the eccentric cam driving the individual pump pistons, for instance, can be connected with the impeller of a hydrodynamic converter.

The cylinder borings of the radial piston pump are customarily closed, in a radially outward direction, by a valve plug which possesses a centrally located through boring thus forming a pressure passage, wherein all the valve plugs of the radial piston pump are covered by a circumferential band spring. In order to attain a better loading of this band spring by the delivered pump pressure, the plugs, on their upper sides, are provided with parallel striations which terminate within the machined sealing area of the exposed surfaces and the striations are aligned in the circumferential direction of the radial piston pump. In this arrangement, the band spring seals the said centrally located pressure passages as well as the said striations by spring pressure against a collection channel radially located outside of the valve plug. When a radial piston is in the delivery stroke, the band spring is forced free of the sealing surface by means of the pressure in that boring and in the striations which lie in the pressure zone of the radial piston pump.

In the area of the radially, outward directed sides of the pistons, an intake suction port is placed coaxially to the pump axis. This suction port intersects the cylinder boring. Suction intake openings are made by means of this intersection. An annular flow resistance is interposed between the side of the piston and the individual suction port, on each respective piston.

The disadvantage of radial piston pumps of this design is the generation of noise which can extend to an excessive point. These noises arise from the ejection of the oil from the necessary lifting of the band spring. The band spring, when lifted, must push against the pressurized oil standing in the annular collection channel. This burdens the ejection of the oil by the delivering piston and is hence a party to pressure peaks in the cylinder boring which, in the first place, make lifting of the band spring possible.

The purpose of the present invention is to create a radial piston pump with a substantially reduced generation of noise.

SUMMARY OF THE INVENTION

The invention also provides, that in each case, an outlet valve is placed in the pressure passages which penetrate the valve plugs, which valve, on its end proximal to the pump piston, is provided with an impact plate.

Advantageously, both ends of the pressure passage are tapered in a conical manner.

The outlet valve further possesses a valve stem, the end of which, proximate to the annular collection channel, is shaped as a cone or a sphere.

A spring embracing the valve stem is between the impact plate and the valve plug and the spring loads the valve stem toward the closed direction.

Because of the fact that the invented radial piston pump has an outlet valve in each valve plug, instead of having a valve band, the advantage is achieved that only a minimal amount of oil is forced into the collection space, by the controlled expulsion of oil from the cylinder borings, so that pressure peaks at the pump pistons in the cylinder borings are substantially reduced. Upon a forward piston thrust in the pumping of oil, a dynamic pressure, which enables an eased opening of the outlet valve, arises on the impact plate. The expelled oil, on this account, is pumped in all directions in the annular collection channel in contrast to the situation in the case of the conventional band spring, wherein the oil could only exit from the sides of the spring.

BRIEF DESCRIPTION OF THE DRAWINGS

The invention will now be described, by way of example, with reference to the accompanying drawings in which.

DETAILED DESCRIPTION OF THE INVENTION

Radial piston pumps are well known to the pump expert so that, in the following description as well as in the figures, only those components necessary for an understanding of the invention are described and illustrated, whereby the same parts in the figures are provided with the same reference numbers.

Figure 1:
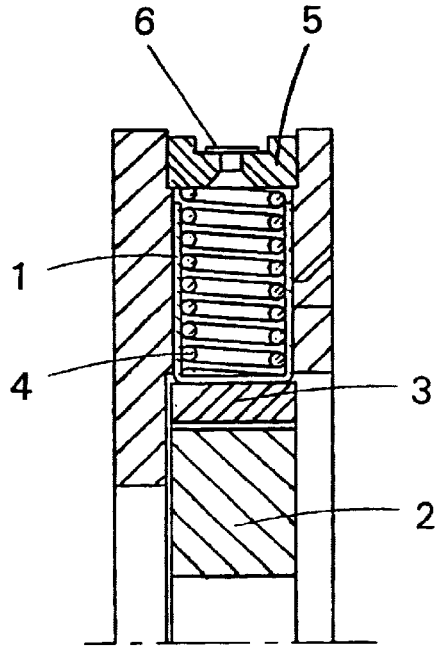
Fig. 1 Prior Art
FIG. 1 is a longitudinal cross section through a conventional radial piston pump.

In FIG. 1, the presented, conventional radial piston pump possesses a pumping piston 1, which can slidingly move in a cylinder boring. The piston 1 is driven by a slip ring 3 powered by a cam 2. The reference number 4 designates the customary piston spring and reference number 5 designates the valve plug which closes the upper end of the cylinder boring. The pressure passage provided in the valve plug 5 is closed by a band spring 6 which causes a strong noise to develop during operation of the radial piston pump.

Figure 2:
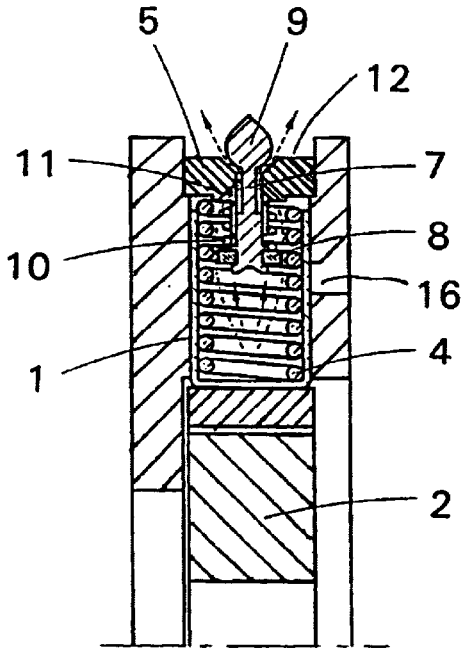
FIG. 2 is a longitudinal cross section through an invented radial piston pump during the delivery stroke.
Figure 3:
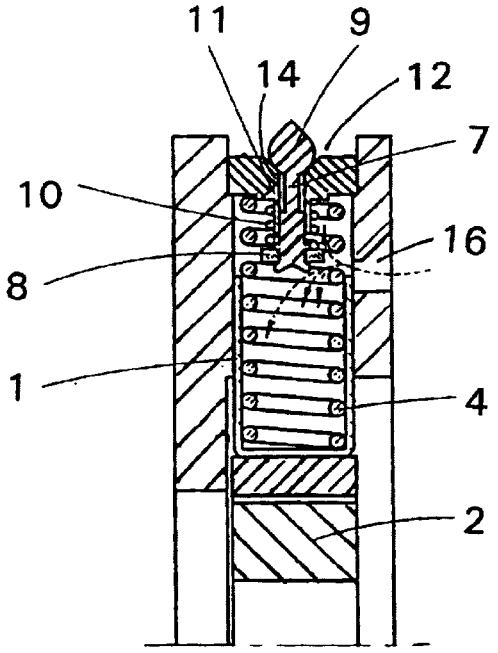
FIG. 3 is a longitudinal cross section through an invented radial piston pump during the suction intake stroke.

In accord with the embodiment presented in FIG. 2, showing an invented radial piston pump, the pumping piston 1 is likewise driven by a cam 2. Instead of the band spring 6 which closes the pressure passage in the valve plug 5, an outlet valve is now shown and provided for each valve plug 5 of the radial piston pump. This outlet valve possesses a stem 7 has a lower end, proximate to the pumping piston, which has an impact plate 8 attached thereto. The valve stem 7 is provided to slide in the pressure passage 14 of the valve plug 5 whereby, according to this embodiment, both the under surface of the pressure passage, at location 11, as well as the upper surface proximate to the annular collection channel 12, are conically shaped surface. The upper end of the valve stem 7 is correspondingly provided with a section 9, shaped as a frustum of a cone, for closing the pressure passage during a closure phase of the outlet valve (see intake suction position per FIG. 3). In another embodiment, the section 9 of the valve stem 7, for instance, can be designed as a spherically shaped member (not shown).

FIG. 2 shows the pumping piston 1 during its delivery phase in which the conical frustum shaped section 9, as seen in this embodiment for example, is lifted clear of the conical shaped surface of the pressure passage so that oil, corresponding to the two depicted arrows, can flow into an annular collection channel 12.

During the intake suction stroke of the pump piston 1 (FIG. 3), the pump piston 1 uncovers the suction port 16 so that the fluid, i.e., the oil, flows into the cylinder boring because of the lower pressure. Due to the impact plate 8 and because of the necessary space taken by the outlet valve, the oil first predominately flows into the lower half of the cylinder boring (the oil flow is shown by a dotted line). During the course of the subsequent movement of the pump piston 1 (FIG. 2), the suction opening 16 is closed and the oil, which has collected under the impact plate 8, can now flow past this plate 8 toward the pressure passage whereby, a dynamic pressure arises underneath the impact plate 8 which enables the opening of the outlet valve.

Subsequently, after exiting exit from the pressure passage, the oil can disperse itself in all directions into a storage or collection space. This is contrary to the conditions with the conventional band spring where the oil could only escape laterally from the band spring.

Once the pump piston 1 has terminated the delivery stroke, then the outlet valve closes by means of the valve spring 10 which is positioned between the impact plate 8 and the underside of the valve plug 5. During this closure, the force of the spring 10 is supported by the still elevated pressure in the storage space. The pump piston 1 can now induce suction to renew the intake of oil.

Because of the components of the outlet valve placed in the cylinder boring, only a small quantity of oil is expressed into the annular collection channel 12 upon the opening of the outlet valve. On this account, by the provision of the impact plate 8, early opening of the outlet valve upon pumping stroke is assured so that the pressure peaks, in the cylinder boring and at the pump piston, can be reduced.

It is to advantage if the impact plate 8 lies above the suction opening 16 so that the entering oil flows, as unrestrictedly as possible, into the lower half of the cylinder boring. Employing the annular space between the impact plate and the coil spring 4 of the valve, the through-flow speed of the oil upon thrust movement of the piston, and therewith the generated dynamic pressure underneath the impact plate 8, can be adjustable. Further, the oil flow into the cylinder boring upon the thrust motion can be changed by means of the shape of the impact plate 8 which relative to the base of the pump piston 1, for example, can be designed to be concave, convex, or conical. This permits the function of the outlet valve to be adjusted within certain limits.

Reference Number and Parts

1 pump piston
2 cam
3 slip ring
4 valve piston spring (coil)
5 valve plug
6 band spring (circumferential)
7 Valve stem
8 Impact plate
9 Section
10 Valve spring (around stem)
11 Location
12 Annular collection channel
14 Pressure passage
16 Suction port

What is claimed is:

1. A radial piston pump having a pump body with a plurality of cylinder borings formed therein with each cylinder boring accommodating a respective pump piston, each respective pump piston being driving by a cam and each cylinder boring being closed by a respective valve plug, each respective valve plug having a pressure passage formed therein which communicates with an annular collection channel, a suction opening being provided in each cylinder boring, and the respective pump piston being accommodated within the cylinder boring and being slidable relative to the cylinder boring for opening and closing the suction opening;

wherein each pressure passage is formed in and extends through the respective valve plug (5), and an outlet valve controls a flow of fluid through the pressure passage, the outlet valve comprises has a valve stem (7) with a sealing section at one end thereof and an impact plate (8) supported adjacent an opposite end of the valve stem (7) located proximate to the cam but spaced radially outward relative to the suction opening.

2. The radial piston pump according to claim 1, wherein an end of the pressure passage proximate to the cam is beveled.

3. The radial piston pump according to claim 1, wherein an end of the pressure passage proximate to the annular collection channel is beveled and engages with the valve stem when the valve stem is in a closed position.

4. The outlet valve according to claim 1, wherein an end of the valve stem (7), proximate to the annular collection channel, has a section (9) which has a conical frustum shape.

5. The outlet valve according to claim 1, wherein an end of the valve stem (7), proximate to the annular collection channel, has a section (9) which is spherical shaped.

6. The radial piston pump according to claim 1, wherein a valve spring (10) is located between the impact plate (8) and the valve plug (5) and the valve spring biases the valve stem (7) toward a closed position.

7. The radial piston pump according to claim 6, wherein when the valve stem (7) is in its closed position, the impact plate (8) is sufficiently spaced from the suction opening (16) to facilitate entry of the fluid through the suction opening (16) and into a lower half of the cylinder boring.

8. A radial piston pump having a pump body with a plurality of cylinder borings formed therein with each cylinder boring accommodating a respective pump piston, each respective pump piston being driving by a cam and each cylinder boring being closed by a respective valve plug, each respective valve plug having a pressure passage formed therein which communicates with an annular collection channel, a suction opening being provided in each cylinder boring, and the respective pump piston being accommodated within the cylinder boring and being slidable relative to the cylinder boring for opening and closing the suction opening;

wherein each pressure passage is formed in and extends through the respective valve plug (5), and an outlet valve controls a flow of fluid through the pressure passage, the outlet valve comprises has a valve stem (7) with a sealing section at one end thereof and an impact plate (8) supported adjacent an opposite end of the valve stem (7) located proximate to the cam but spaced radially outward relative to the suction opening, a piston spring biases the pump piston toward an open position which permits a flow of. the fluid into the cylindrical boring, and a valve spring (10) is located between the impact plate (8) and the valve plug (5) and the valve spring biases the valve stem (7) toward a closed position.

9. A radial piston pump having a pump body having a cylinder boring formed therein with the cylinder boring accommodating a pump piston, the pump piston being driving by a cam and the cylinder boring being closed by a valve plug, the valve plug having a pressure passage formed therein which communicates with an annular collection channel, a suction opening being provided in the cylinder boring, and the pump piston being accommodated within the cylinder boring and being slidable relative to the cylinder boring for opening and closing the suction opening;

wherein the pressure passage is formed in and extends through the valve plug (5), both opposed surfaces of the pressure passage are beveled, and an outlet valve controls a flow of fluid through the pressure passage, the outlet valve comprises has a valve stem (7) with a sealing section at one end thereof and an impact plate (8) supported adjacent an opposite end of the valve stem (7) located proximate to the cam but spaced radially outward relative to the suction opening, a piston spring biases the pump piston toward an open position which permits a flow of the fluid into the cylindrical boring, and a valve spring (10) is located between the impact plate (8) and the valve plug (5) and the valve spring biases the valve stem (7) toward a closed position.

* * * * *